US008287084B2

(12) United States Patent
Ito

(10) Patent No.: US 8,287,084 B2
(45) Date of Patent: Oct. 16, 2012

(54) RECORDING APPARATUS

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 451 days.

(21) Appl. No.: 12/543,333

(22) Filed: Aug. 18, 2009

(65) Prior Publication Data

US 2010/0053254 A1 Mar. 4, 2010

(30) Foreign Application Priority Data

Sep. 1, 2008 (JP) ..... 2008-223398

(51) Int. Cl.
*B41J 2/165* (2006.01)

(52) U.S. Cl. ..... 347/23; 347/14; 347/5

(58) Field of Classification Search ..... 347/5, 9, 347/14, 16, 104, 19, 23
See application file for complete search history.

(56) References Cited

U.S. PATENT DOCUMENTS

| | | | | |
|---|---|---|---|---|
| 5,526,028 | A | 6/1996 | Rottman | |
| 6,511,172 | B2 * | 1/2003 | Tanno et al. | 347/104 |
| 7,399,048 | B2 | 7/2008 | Inoue | |
| 2003/0128253 | A1 | 7/2003 | Kitahara et al. | |
| 2006/0139395 | A1 | 6/2006 | Nakashima et al. | |
| 2006/0232624 | A1 | 10/2006 | Inoue | |
| 2007/0171251 | A1 | 7/2007 | Sekimoto et al. | |
| 2008/0225068 | A1 * | 9/2008 | Morino et al. | 347/14 |

FOREIGN PATENT DOCUMENTS

| | | | |
|---|---|---|---|
| EP | 1674268 | A1 | 6/2006 |
| JP | H04-039041 | A | 2/1992 |
| JP | H08-324067 | A | 12/1996 |
| JP | H11-192768 | A | 7/1999 |
| JP | 2003-285450 | A | 10/2003 |
| JP | 2004-009530 | A | 1/2004 |
| JP | 2004-250208 | A | 9/2004 |
| JP | 2005-043195 | A | 2/2005 |
| JP | 2005-096229 | A | 4/2005 |
| JP | 2005-104147 | A | 4/2005 |
| JP | 2005-342899 | A | 12/2005 |
| JP | 2006-175772 | A | 7/2006 |
| JP | 2007-196444 | A | 8/2007 |
| JP | 2007-210113 | A | 8/2007 |
| JP | 2008-044266 | A | 2/2008 |

OTHER PUBLICATIONS

European Patent Office; Extended European Search Report for Patent Application No. EP09166113, dated Jan. 12, 2011. (counterpart to above-captioned U.S. patent application). Japan Patent Office; Notification of Reason for Refusal in Japanese Patent Application No. 2008-223398 (counterpart to the above-captioned US Patent Application) mailed on Jul. 13, 2010.

* cited by examiner

*Primary Examiner* — Lam S Nguyen
(74) *Attorney, Agent, or Firm* — Baker Botts L.L.P.

(57) ABSTRACT

There is disclosed a recording apparatus including a recording head, a feeding mechanism, a detector, and a controller. The recording head has an ejection surface from which a droplet of a liquid is ejected. The feeding mechanism includes a plurality of rollers and an endless feeder belt wound around the rollers and having a feeding surface opposed to the ejection surface, and feeds a recording medium placed on the feeding surface a part of which serves as a liquid-droplet ejection area onto which a droplet of the liquid is ejected. The detector detects a trigger for initiating a manual cleansing of the liquid-droplet ejection area. The controller controls the feeding mechanism such that when the detector detects the trigger, the liquid-droplet ejection area is located at a cleansing position where the liquid-droplet ejection area is not opposed to the ejection surface of the recording head.

20 Claims, 8 Drawing Sheets

RECORDING APPARATUS

CROSS REFERENCE TO RELATED APPLICATION

The present application claims priority from Japanese Patent Application No. 2008-223398, which was filed on Sep. 1, 2008, the disclosure of which is herein incorporated by reference in its entirety.

BACKGROUND OF THE INVENTION

1. Field of the Invention

The present invention relates to a recording apparatus which ejects a liquid droplet onto a recording medium so as to record an image thereon.

2. Description of Related Art

As an inkjet printer which records an image on a recording sheet as a recording medium by ejecting ink droplets onto the recording sheet, there is known one including a feeding mechanism and an inkjet recording head. The feeding mechanism includes a plurality of rollers and an endless feeder belt wound around the rollers. The recording head has an ejection surface in which a plurality of nozzles open so that ink droplets are ejected therefrom onto the recording sheet placed on an outer circumferential surface of the feeder belt. In such an inkjet printer, it is known to inspect the state of the nozzles, that is, to check that an ink droplet can be normally ejected from each nozzle, by ejecting an ink droplet from each nozzle to form or print a test pattern on a test print area provided at a part of the outer circumferential surface of the feeder belt, and then reading the printed test pattern by means of a line sensor disposed downstream of the recording head with respect to a sheet feed direction, which is a direction in which the recording sheet is fed by the feeding mechanism. For instance, such a technique is disclosed in JP-A-2005-104147.

This technique involves a belt cleaning mechanism operated to cleanse the test print area each time the test pattern has been printed on the test print area. However, it is difficult to completely remove the contamination on the test print area by the belt cleaning mechanism only, and sometimes it is necessary to implement a manual cleansing of the test print area by a user or an operator. Since the feeder belt and the recording head are disposed close to each other in the inkjet printer, the manual cleansing is troublesome or awkward. Further, a hand of the operator may contact the recording head during the manual cleansing, which leads to contamination of the ejection surface of the recording head or displacement of the recording head.

SUMMARY OF THE INVENTION

This invention has been developed in view of the above-described situations, and it is an object of the invention, therefore, to provide a recording apparatus which facilitates a manual cleansing of a liquid-droplet ejection area by a user, while preventing contact between a hand of the user and a recording head.

To attain the above object, the invention provides a recording apparatus including a recording head, a feeding mechanism, a detector, and a controller. The recording head has an ejection surface from which a droplet of a liquid is ejected. The feeding mechanism includes a plurality of rollers and an endless feeder belt wound around the rollers and having a feeding surface opposed to the ejection surface, and feeds a recording medium placed on the feeding surface a part of which serves as a liquid-droplet ejection area onto which a droplet of the liquid is ejected. The detector detects a trigger for initiating a manual cleansing of the liquid-droplet ejection area. The controller controls the feeding mechanism such that when the detector detects the trigger, the liquid-droplet ejection area is located at a cleansing position where the liquid-droplet ejection area is not opposed to the ejection surface of the recording head.

According to the recording apparatus, when the liquid-droplet ejection area is to be manually cleansed, the liquid-droplet ejection area is located at the cleansing position where the liquid-droplet ejection area is not opposed to the ejection surface of the recording head. This facilitates the manual cleansing, and inhibits a user from inadvertently contacting the recording head during the manual cleansing.

BRIEF DESCRIPTION OF THE DRAWINGS

The above and other objects, features, advantages and technical and industrial significance of the present invention will be better understood by reading the following detailed description of one preferred embodiment of the invention, when considered in connection with the accompanying drawings, in which.

DETAILED DESCRIPTION OF PREFERRED EMBODIMENTS

Hereinafter, there will be described an inkjet printer as one presently preferred embodiment of the invention, by referring to the accompanying drawings.

Figure 1:
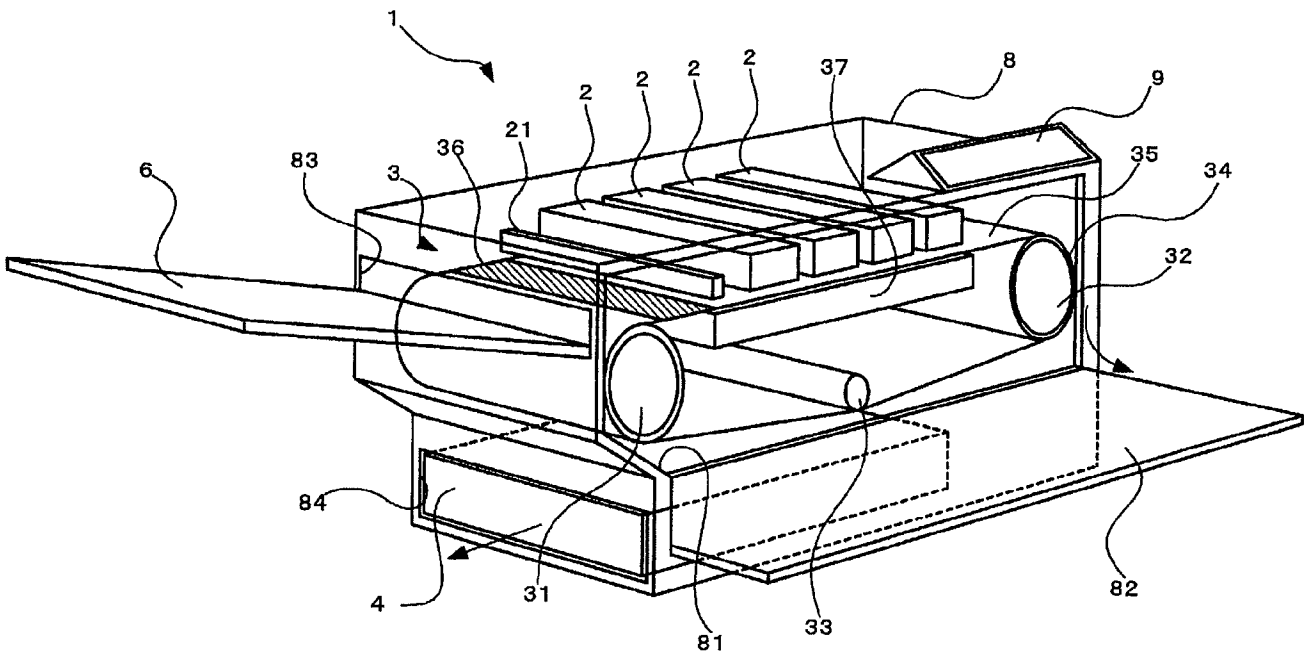
FIG. 1 is a schematic external perspective view of an inkjet printer according to one embodiment of the invention.
Figure 2:
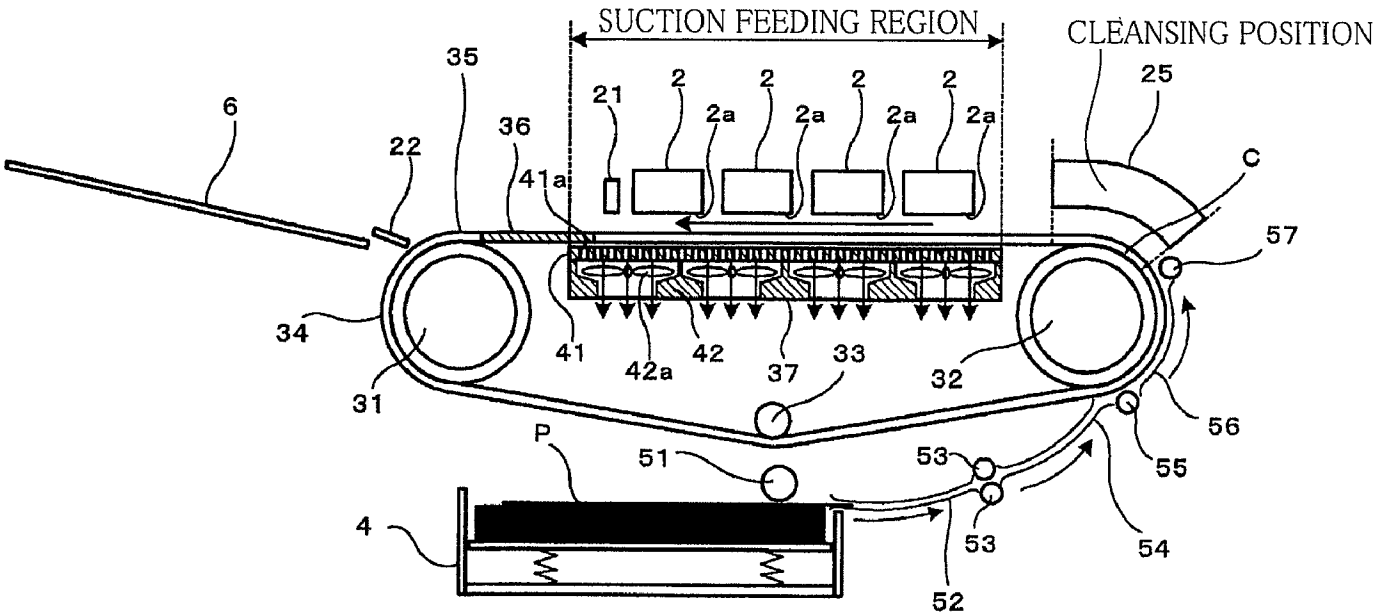
FIG. 2 is a schematic side view of the inkjet printer.

Referring first to FIG. 1, which shows a general structure of the inkjet printer, reference numeral 1 denotes the inkjet printer. The inkjet printer 1 has a housing 8, which is not transparent but is represented as if transparent in FIG. 1 in order to show an internal structure of the inkjet printer 1. FIG. 2 shows the internal structure of the inkjet printer 1.

As shown in FIGS. 1 and 2, the inkjet printer 1 is a color inkjet printer including four inkjet recording heads 2. The inkjet printer 1 further includes a sheet supply cassette 4, a feeding mechanism 3, a catch tray 6, the housing 8 accommodating the feeding mechanism 3 and the sheet supply cassette 4, and a control unit 7 (shown in FIG. 4) for controlling operations of the inkjet printer 1. In the housing 8, the recording heads 2, the feeding mechanism 3, and the sheet supply cassette 4 are vertically arranged from top down in the order of description. The catch tray 6 is disposed at a front side, i.e., a left side as seen in FIG. 1, of the housing 8. A recording sheet P as a recording medium is fed through the feeding mechanism 3 and along a sheet feed path that extends from the sheet supply cassette 4 to the catch tray 6. The recording sheet P is fed in the direction as indicated by arrows in FIG. 2, which will be hereinafter referred to as "the sheet feed direction".

The sheet supply cassette 4 accommodates a stack of recording sheets P, and is detachably inserted in the inkjet printer 1 from an opening 84 formed in a front lower portion of the housing 8. An upper surface of a topmost one of the recording sheets P stacked in the sheet supply cassette 4 is in contact with a pickup roller 51. By rotating the pickup roller 51, the topmost recording sheet P is supplied or fed into the sheet feed path in the sheet feed direction, that is, rightward as seen in FIG. 2.

The feeding mechanism 3 is disposed above and on the downstream side of the sheet supply cassette 4 with respect to the sheet feed direction. The feeding mechanism 3 operates to feed a recording sheet P, and includes guide members 52, 54, 56, a pair of feeder rollers 53, nip rollers 55, 57, a first belt roller 32 (as a first roller), a second belt roller 31 (as a second roller), a tension roller 33, an endless feeder belt 34 wound around the first and second belt rollers 32, 31 and the tension roller 33, and a platen 37 disposed inside a circle of the feeder belt 34 as seen in the side view of FIG. 2.

The guide members 52, 54, 56 guide a recording sheet P as supplied from the sheet supply cassette 4 in the sheet feed direction, to a position to be opposed to a part of an outer circumferential surface of the feeder belt 34 corresponding to the first belt roller 32. The feeder rollers 53 are interposed between the guide members 52 and 54, and nip therebetween the recording sheet P to feed the recording sheet P. The nip rollers 55, 57 are disposed adjacent to the first belt roller 32 and on the two opposite sides of the guide member 56 with respect to the sheet feed direction, respectively, and function to press the recording sheet P being fed against the outer circumferential surface of the feeder belt 34. The recording sheet P driven by the pickup roller 51 and the feeder rollers 53 are fed under guidance of the guide members 52, 54, 56 to the position to be opposed to the part of the outer circumferential surface of the feeder belt 34 corresponding to the first belt roller 32. At this position, the recording sheet P is pressed by the nip rollers 55, 57 against the outer circumferential surface of the feeder belt 34, and thereby placed on the outer circumferential surface of the feeder belt 34.

Figure 3:
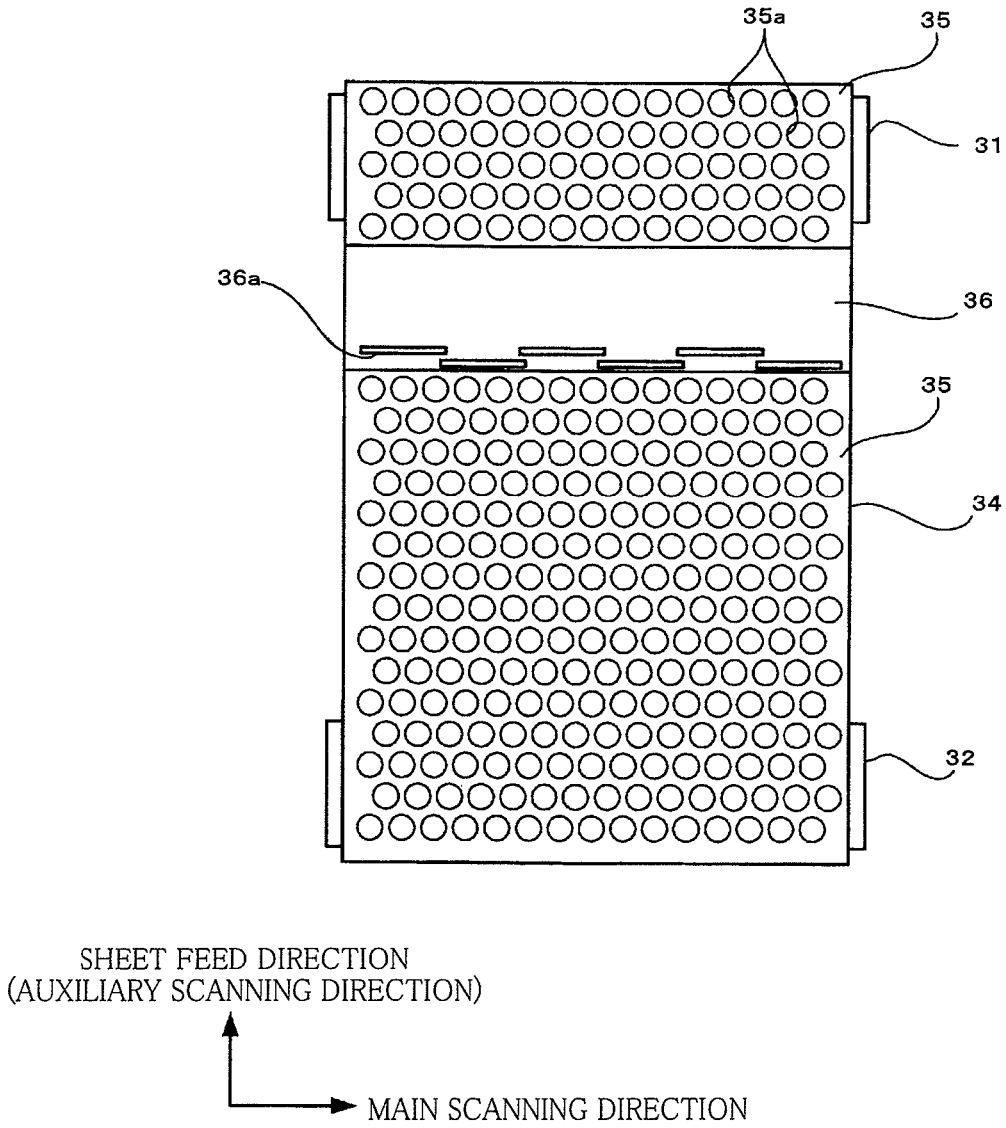
FIG. 3 is a plan view of a feeding mechanism shown in FIG. 1.

Referring further to FIG. 3 which is a plan view of the feeding mechanism 3, the feeder belt 34 will be described. As shown in FIGS. 1-3, the outer circumferential surface of the feeder belt 34 serves as a feeding surface on which a recording sheet P is held when fed. More specifically, the feeding surface includes a sheet holding area 35 and an ink-droplet ejection area 36. The sheet holding area 35 is an area within which a recording sheet P is placed, and the ink-droplet ejection area 36 is an area within which ink droplets are ejected from the recording heads 2 in a nozzle inspection that will be described later. A dimension of the ink-droplet ejection area 36 in the circumferential direction of the feeder belt 34 is larger than a dimension of an ejection surface 2*a* (described later) of the recording heads 2 in the same direction. A dimension of the ink-droplet ejection area 36 in a width direction of the feeder belt 34 corresponds to an entire width of the feeder belt 34. The sheet holding area 35 corresponds to the other part of the feeding surface (or the outer circumferential surface) of the feeder belt 34 than the ink-droplet ejection area 36.

At the sheet holding area 35, the feeding surface is coated with silicon resin and has weak adhesion. A large number of suction holes 35*a* are formed across the sheet holding area 35. A recording sheet P placed on the sheet holding area 35 having weak adhesion is held there by the adhesion. When a part of the sheet holding area 35 is located within a suction feeding range opposed or corresponding to the platen 37, a corresponding part of the feeder belt 34 which is opposed or corresponding to the platen 37 is sucked by the platen 37 from the lower side, with an air flow generated at the suction holes 35*a* from an upper side to a lower side thereof. Thus, at the suction feeding range, the recording sheet P is held on the sheet holding area 35 by the suction. In this way, it is reliably prevented that a recording sheet P levitates at a range where the recording sheet P is opposed to the ejection surfaces 2*a*.

The ink-droplet ejection area 36 is an area within which a test pattern is printed in a nozzle inspection described later. The test pattern printed in the ink-droplet ejection area 36 is read by an image sensor 21 disposed downstream of the recording heads 2 with respect to the sheet feed direction. At the ink-droplet ejection area 36, the feeding surface, i.e., the outer circumferential surface, of the feeder belt 34 is white in color, in order to ensure a sufficiently high precision and accuracy in the reading by the image sensor 21 of the test pattern printed on the ink-droplet ejection area 36. The feeder belt 34 has a plurality of slits 36*a* formed within the ink-droplet ejection area 36, more specifically, in a vicinity of one of two opposite edges of the ink-droplet ejection area 36 in the circumferential direction of the feeder belt 34, which one edge is on the downstream side with respect to the sheet feed direction. The slits 36*a* extend in the width direction of the feeder belt 34, and are arranged in a staggered manner in the width direction of the feeder belt 34. The slits 36*a* are openings toward which ink droplets are ejected from the recording heads 2 in a flushing operation described later. On an inner circumferential surface of the feeder belt 34, a sponge member (not shown) is attached at a position corresponding to the slits 36*a*. The ink droplets ejected to the slits 36*a* in the flushing operation go through the slits 36*a* and are absorbed by the sponge member. At the ink-droplet ejection area 36, the feeding surface of the feeder belt 34 is liquid-repellent to enable easy removal of the test pattern printed and the ink(s) adhering to the feeding surface around the slits 36*a*. The ink-droplet ejection area 36 is fixed in position at a portion of the feeder belt 34, which may correspond to a recessed portion formed on an outer circumferential surface of the feeder belt 34, or a portion of the feeder belt 34 where the color or the forming material is different from that of the other portion of the feeder belt 34, for instance.

Referring back to FIGS. 1 and 2, the second belt roller 31 is connected with a feed motor 11 (shown in FIG. 4) controlled by the control unit 7. By rotating the second belt roller 31 by the feed motor 11, the feeder belt 34 is circulated. A recording sheet P placed on the feeder belt 34 is fed by the feeder belt 34 being circulated. To the feed motor 11, a rotary encoder (not shown) is attached. The control unit 7 obtains a position (hereinafter referred to as "the traveling position") of the feeder belt 34 with respect to the direction of its circulation, on the basis of a signal outputted from the rotary encoder. The tension roller 33 gives a predetermined degree of tension to the feeder belt 34.

At a position where the feeder belt 34 is opposed to the ejection surfaces 2*a* of the recording heads 2, the platen 37 supports the feeder belt 34 so as to prevent downward sagging of the feeder belt 34, and sucks a recording sheet P in the sheet holding area 35 on the feeder belt 34 so as to hold the recording sheet P there. As shown in FIG. 2, the platen 37 includes a top plate 41 and a suction box 42. In the top plate 41, a large number of through-holes 41*a* are formed. The suction box 42 is connected to an under surface of the top plate 41. In the suction box 42, a plurality of suction chambers are formed such that each suction chamber vertically extends across an entire vertical dimension of the suction box 42. In each of the suction chambers, a fan 42*a* is disposed. Rotation of the fan 42*a* generates an air flow from opening ends of the through-holes 41*a* at an upper surface of the top plate 41 downward through the suction chamber. While the sheet holding area 35 of the feeder belt 34 passes through the suction feeding range which corresponds to an entire surface of the platen 37 at the side opposed to the ejection surfaces 2*a* of the recording heads 2, the part of the feeder belt 34 corresponding to the suction feeding range is sucked by the platen 37 from the lower side which is opposite to the sheet holding area 35. Hence, at the suction holes 35*a*, the air flow from the upper side thereof downward is formed. The recording sheet P is thus held on the sheet holding area 35 by the suction.

Downstream of the feeder belt 34 with respect to the sheet feed direction, a separating plate 22 is disposed so as to separate from the sheet holding area 35 of the feeder belt 34 a recording sheet P held thereon. The recording sheet P separated from the sheet holding area 35 by the separating plate 22 is ejected onto the catch tray 6 through an ejection opening 83 formed in a front upper portion of the housing 8.

Figure 5:
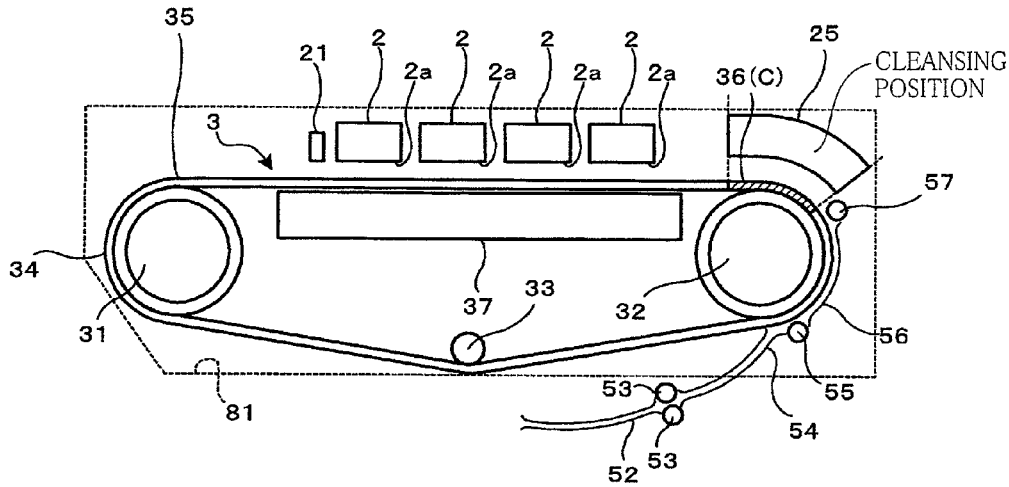
FIGS. 5-7 are schematic side views showing the feeding mechanism in different states.
Figure 6:
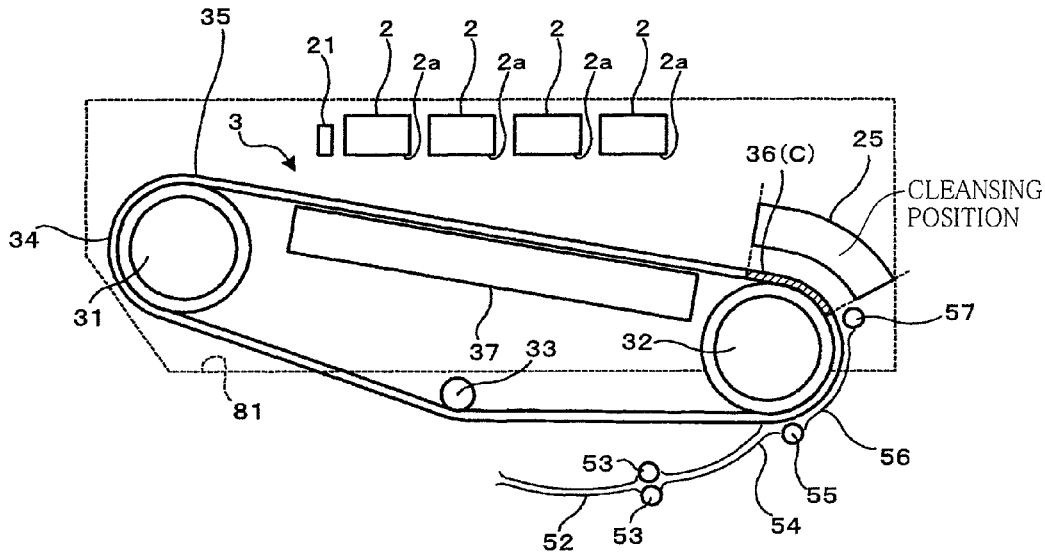

The feeding mechanism 3 can be turned or swung about an axis or shaft of the second belt roller 31 by a manipulation of a handle (not shown) by a user, as shown in FIGS. 5 and 6. This action is made when a recording sheet P causing jam between the recording heads 2 and the feeder belt 34 is to be eliminated, or when a manual cleansing of the ink-droplet ejection area 36 is to be implemented.

Immediately downstream of the recording heads 2 is disposed the image sensor 21, which is a line sensor including a plurality of lenses arranged in the width direction of the feeder belt 34 and a photodetector (not shown) for detecting light from the lenses. The image sensor 21 reads the test pattern printed in the ink-droplet ejection area 36 in the nozzle inspection described later.

The four recording heads 2 are for ejecting four color inks, namely, magenta, yellow, cyan, and black inks, respectively, and fixed in position. The recording heads 2 are arranged in the sheet feed direction. Thus, the inkj et printer 1 is a line printer. Each recording head 2 has the shape of a rectangular parallelepiped long in a main scanning direction that is perpendicular to the sheet feed direction. Under surfaces of the recording heads 2 constitute the ejection surfaces 2*a* opposed to the outer circumferential surface of the feeder belt 34. In each of the ejection surfaces 2*a*, a large number of nozzles are open so as to eject ink droplets therefrom. When a recording sheet P fed on and by the feeder belt 34 passes under the four recording heads 2 sequentially, droplets of the respective color inks are ejected from the nozzles open in the ejection surfaces 2*a* onto an upper surface, i.e., a recording surface, of the recording sheet P. In this way, a desired color image can be recorded within a recording area on the recording sheet P. Since the recording sheet P is held by the suction on the feeder belt 34 within the sheet holding area 35, the recording sheet P is prevented from levitating, thereby ensuring accurate recording on the recording sheet P.

A part of a range where the outer circumferential surface of the feeder belt 34 faces upward, at which part the feeder belt 34 is on the first belt roller 32, is defined as a cleansing position C. More specifically, the cleansing position C has a definite range including at least a part of a range where a portion of the outer circumferential surface of the feeder belt 34, which portion corresponds to, and is on the opposite side of, a contact portion of the inner circumferential surface of the feeder belt 34 where the inner circumferential surface is in contact with the first belt roller 32, is located. In this specific example, the cleansing position C is predetermined to be located downstream of the nip roller 57 with respect to the sheet feed direction. It is noted that the term "a range where the outer circumferential surface of the feeder belt 34 faces upward" is to be interpreted as referring to a range where the outer circumferential surface of the feeder belt 34 faces upward when the feeding mechanism 3 is swung or turned about the shaft or axis of the second belt roller 31 to the position as shown in FIG. 6, in view of the visibility (or easiness to see) of the ink-droplet ejection area 36 as located at the cleansing position C. However, this term may be interpreted as referring to a range where the outer circumferential surface of the feeder belt 34 faces upward when the feeding mechanism 3 is in the position as shown in FIG. 5. Further, when the angle by which the feeding mechanism 3 is swung or turned from the position shown in FIG. 5 is relatively small, the term may be interpreted as referring to a range above an imaginary plane including both the axis of the second belt roller 31 and an axis of the first belt roller 32. It is noted that the cleansing position C is outside the suction feeding range which includes regions opposed to the respective ejection surfaces 2*a*. The cleansing position C corresponds to a position where the ink-droplet ejection area 36 is located when a user is to manually cleanse the ink-droplet ejection area 36 on the feeder belt 34. Above the first belt roller 32, there is disposed a plate 25 on which a mark "CLEANSING POSITION" indicating the cleansing position C is putted. The plate 25 is detachably attached in an orientation such that when a user sees the inside of the housing 8 along an axial direction of the first and second belt rollers 32, 31 from the outside of a maintenance opening 81, the user can see the mark "CLEANSING POSITION" on the plate 25.

The housing 8 accommodates the four recording heads 2, the feeding mechanism 3, and the sheet supply cassette 4. The maintenance opening 81 is formed at a right side (i.e., a near side in the main scanning direction) of the housing 8 for use in a maintenance operation implemented on the inkjet printer 1. That is, the feeding mechanism 3 is seeable by a user in the axial direction of the first and second belt rollers 32, 31 from the outside of the inkjet printer 1 through the maintenance opening 81, and the user can perform operations on the feeding mechanism 3 from the outside of the housing 8. The housing 8 has a cover 82 and a cover opening sensor 12 (shown in FIG. 4). The cover 82 is openable and closable and covers the maintenance opening 81 when closed. The cover opening sensor 12 detects the state of the cover 82, that is, whether the cover 82 is open or closed. When the inside of the housing 8 is seen from the outside thereof through the maintenance opening 81 and along the axial direction of the first and second belt rollers 32, 31, the cleansing position C is on the right side of the recording heads 2.

In the front upper portion of the housing 8 is formed the ejection opening 83 through which a recording sheet P fed by the feeder belt 34 with an image recorded thereon is ejected onto the catch tray 6. In the front lower portion of the housing 8 is formed the opening 84 from which the sheet supply cassette 4 is inserted into and pulled out of the inkjet printer 1. At an upper end of the right side of the housing 8, a touch panel 9 (corresponding to a display portion) is disposed. The touch panel 9 is an operator panel for informing a user of the status of the inkjet printer 1, and allowing input of an instruction. Thus, at the right side of the housing 8 are disposed the operator panel and the maintenance opening 81, whereby the user can implement various maintenance operations through the maintenance opening 81 while seeing information presented on the touch panel 9. Thus the maintenance operations are facilitated.

Figure 4:
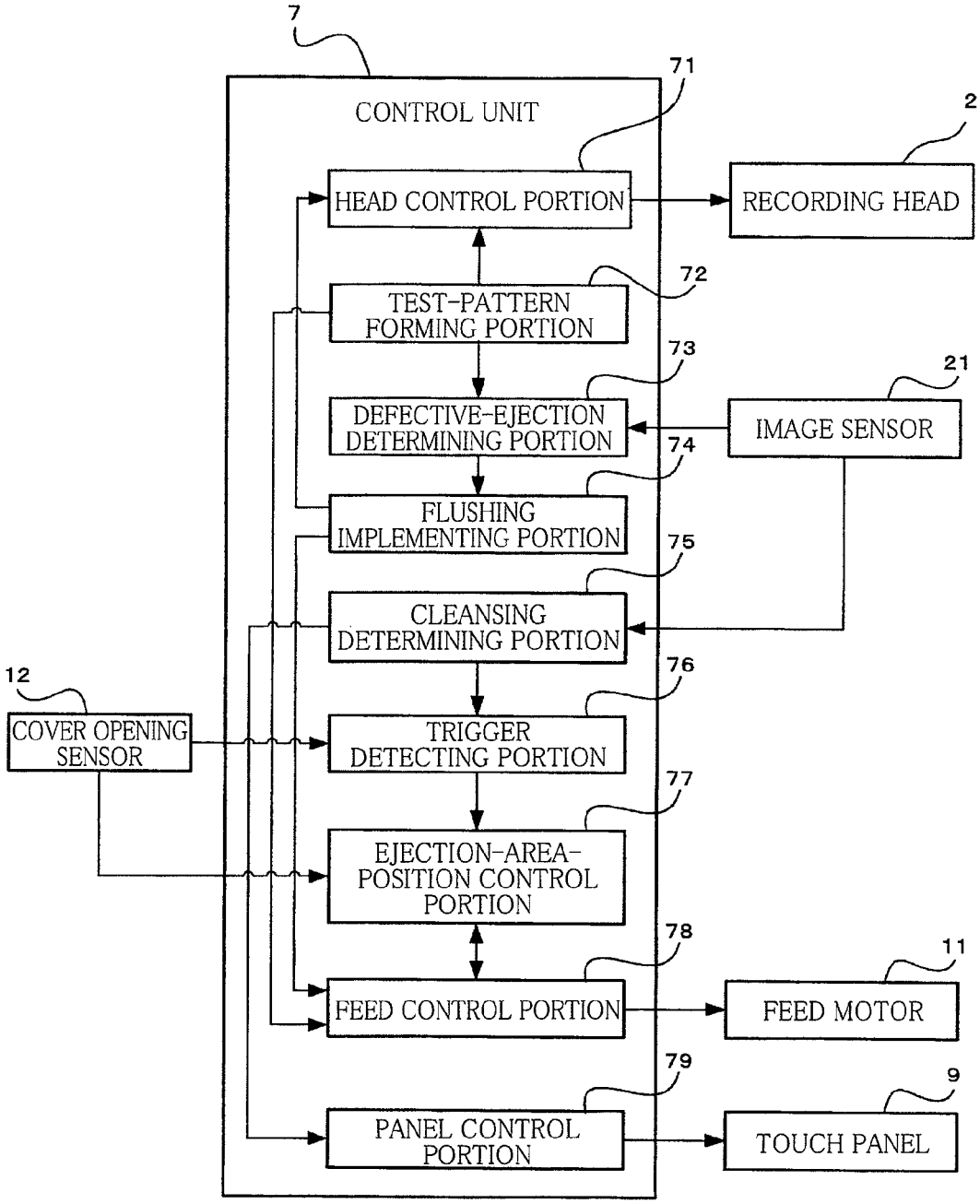
FIG. 4 is a functional block diagram of a control unit of the inkjet printer.

There will be now described the control unit 7, with reference to FIG. 4 which is a functional block diagram of the control unit 7. As shown in FIG. 4, the control unit 7 includes a head control portion 71, a feed control portion 78, a panel control portion 79, a test-pattern forming portion 72, a defective-ejection determining portion 73, a flushing implementing portion 74, a cleansing determining portion 75, a trigger detecting portion 76 (corresponding to a detector), and an ejection-area-position control portion 77.

There will be one by one described the functional portions of the control unit 7. The head control portion 71 controls ejection of ink droplets from the recording heads 2. The feed control portion 78 controls the feed motor 11 so as to vary in a predetermined pattern the speed at which the feeder belt 34 travels or circulates. The feed control portion 78 obtains the traveling position of the feeder belt 34 on the basis of the signal outputted from the rotary encoder (not shown) attached to the feed motor 11, and can control the position of the feeder belt 34. The panel control portion 79 controls the touch panel 9.

The test-pattern forming portion 72 controls the head control portion 71 and the feed control portion 78 to print the test pattern in the ink-droplet ejection area 36, when the nozzle inspection is implemented to check whether an ink droplet can be normally ejected from each nozzle. Preferably, the test pattern may be a bunch of straight lines formed by the respective nozzles and extending in the sheet feed direction, for instance. In the case where such a test pattern is employed, when an ink droplet cannot be normally ejected from any abnormal nozzle, a straight line is not formed normally by the abnormal nozzle.

The defective-ejection determining portion 73 determines whether an ink droplet is normally ejected from each nozzle, on the basis of the test pattern printed on the ink-droplet ejection area 36. More specifically, the defective-ejection determining portion 73 makes the image sensor 21 read the straight lines corresponding to the respective nozzles while the ink-droplet ejection area 36 with the test pattern printed thereon passes under the image sensor 21. The defective-ejection determining portion 73 determines whether the straight lines of the test pattern are formed at predetermined positions in predetermined sizes. When the defective-ejection determining portion 73 determines that any one of the straight lines is defective, that is, not formed at the predetermined position or in the predetermined size, the defective-ejection determining portion 73 determines that the nozzle corresponding to the defective straight line is abnormal and cannot normally eject an ink droplet. In such a case, the defective-ejection determining portion 73 determines whether ink-droplet ejection performance with respect to the nozzle corresponding to the defective straight line is satisfactory or not, on the basis of pattern information which relates to the positions and sizes of the straight lines of the test pattern and is supplied from the test-pattern forming portion 72. When the defective-ejection determining portion 73 completes the determination on the ejection performance with respect to all the nozzle(s) corresponding to the defective straight line(s), a belt cleaning mechanism (not shown) is operated to cleanse the ink-droplet ejection area 36 so as to remove the test pattern printed there.

The flushing implementing portion 74 implements the flushing operation when the defective-ejection determining portion 73 determines that ink-droplet ejection performance with respect to any nozzle is not satisfactory. In the flushing operation, the head control portion 71 and the feed control portion 78 are operated to eject ink droplets from the nozzles onto the slits 36*a* formed in the ink-droplet ejection area 36. By implementing the flushing operation, the ejection performance of the nozzle whose ejection performance has been determined to be unsatisfactory is restored to a satisfactory level.

The cleansing determining portion 75 determines whether a manual cleansing by a user is necessary to implement. More specifically, while the ink-droplet ejection area 36 passes under the image sensor 21, the cleansing determining portion 75 makes the image sensor 21 read the ink-droplet ejection area 36 to obtain a degree of contamination of the ink-droplet ejection area 36 with the inks, or a degree at which the inks are adhering to the ink-droplet ejection area 36. The property obtained as being representative of the degree at which the inks are adhering to the ink-droplet ejection area 36 may be an average luminance of the ink-droplet ejection area 36, for instance. The cleansing determining portion 75 determines, on the basis of the thus obtained degree at which the inks are adhering to the ink-droplet ejection area 36, whether the manual cleansing is necessary. When determining that the manual cleansing is necessary, the cleansing determining portion 75 makes the panel control portion 79 display or present on the touch panel 9 a message or information prompting the user to implement the manual cleansing. When the cleansing determining portion 75 has made the determination on whether the manual cleansing is necessary, the result of the determination is sent to the trigger detecting portion 76.

The trigger detecting portion 76 detects a trigger for initiating the manual cleansing, which will be hereinafter referred to as "the cleansing trigger". The trigger detecting portion 76 detects the cleansing trigger when the cleansing determining portion 75 determines that the manual cleansing is necessary and it is determined that the cover 82 is opened by a user on the basis of the result of detection by the cover opening sensor 12. The trigger detecting portion 76 does not detect the cleansing trigger when only it is determined that the cover 82 is opened, without the cleansing determining portion 75 determining that the manual cleansing is necessary.

Figure 7:
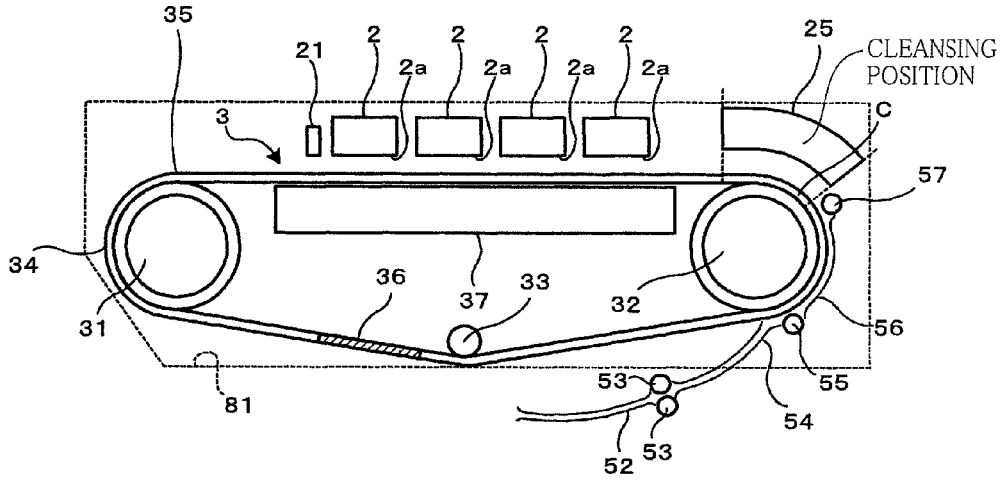

The ejection-area-position control portion 77 makes the feed control portion 78 control the position of the ink-droplet ejection area 36. Referring further to FIGS. 5-7, there will be described an operation of the ejection-area-position control portion 77. FIGS. 5-7 are schematic side views of the feeding mechanism 3 in different states, that is, the position of the part of the feeder belt 34 corresponding to the ink-droplet ejection area 36 is different among FIGS. 5-7. When the trigger detecting portion 76 detects the cleansing trigger, that is, when the cleansing determining portion 75 determining that the manual cleansing is necessary sends the result of the determination to the trigger detecting portion 76 and makes the panel control portion 79 present on the touch panel 9 the message or information prompting the user to implement the manual cleansing, and the user seeing the message or information opens the cover 82 to implement the manual cleansing, the ejection-area-position control portion 77 makes the feed control portion 78 obtain the current traveling position of the feeder belt 34. When the feeder belt 34 is not located at a manual-cleansing position, the ejection-area-position control portion 77 makes the feeder belt 34 travel to a position to locate the ink-droplet ejection area 36 at the cleansing position C, as shown in FIG. 5, and then stops the feeder belt 34 from further traveling.

The user thereafter pulls out or removes the sheet supply cassette 4 from the inkjet printer 1 and operates the handle (not shown) to swing or turn the feeding mechanism 3 about the shaft or axis of the second belt roller 31 in a direction to move the first belt roller 32 downward, as shown in FIG. 6, and then implements the manual cleansing. A detailed description of this procedure of the manual cleansing will be provided later.

When the trigger detecting portion 76 does not detect the cleansing trigger, but it is determined on the basis of the result of detection by the cover opening sensor 12 that the cover 82 is opened by the user, the ejection-area-position control portion 77 makes the feed control portion 78 have the feeder belt 34 travel to locate the ink-droplet ejection area 36 within a range where the outer circumferential surface of the feeder belt 34 faces downward, as shown in FIG. 7, and then stop the feeder belt 34 from further traveling, in order that the ink-droplet ejection area 36 is not seeable by the user. The case where the cover 82 is opened without the cleansing trigger being detected corresponds to, for instance, a case where sheet jam occurs between the recording heads 2 and the feeder belt 34 and the recording sheet P causing the jam is to be eliminated. It is noted that the term "a range where the outer circumferential surface of the feeder belt 34 faces downward" refers to such a range in the state where the feeding mechanism 3 is in the position as shown in FIG. 6, which is the position where the feeding mechanism 3 is placed after being turned or swung about the shaft or axis of the second belt roller 31. However, this term may be interpreted as referring to a range where a part of the outer circumferential surface of the feeder belt 34 that faces downward is located in the state where the feeding mechanism 3 is in the position as shown in FIG. 5.

There will be described the procedure taken by the user in the manual cleansing. When the cleansing determining portion 75 determines that the manual cleansing is necessary, the message or information prompting the user to implement the manual cleansing is presented on the touch panel 9. The user seeing the message or information on the touch panel 9 initiates the manual cleansing. Initially, the user opens the cover 82 to implement the manual cleansing. At this time, the trigger detecting portion 76 detects the cleansing trigger, and makes the ejection-area-position control portion 77 have the feed control portion 78 locate the ink-droplet ejection area 36 at the cleansing position C and then stop the feeder belt 34 from further traveling. The user pulls out or removes the sheet supply cassette 4 from the inkjet printer 1, and operates the handle (not shown) to swing or turn the feeding mechanism 3 about the shaft or axis of the second belt roller 31 in the direction to move the first belt roller 32 downward, as shown in FIG. 6. Further, the user detaches or removes the plate 25 to provide above the ink-droplet ejection area 36 a sufficient space for the manual cleansing, thereby facilitating the manual cleansing by the user. When the manual cleansing is complete, the user again operates the handle (not shown) to return the feeding mechanism 3 to the normal position shown in FIG. 2, and inserts the sheet supply cassette 4 back into the inkjet printer 1 and closes the cover 82. Instructions or information prompting the user to implement the above-described steps may be sequentially presented on the touch panel 9 so that the user can go through the procedure of the manual cleansing following the instructions or information.

According to the present embodiment, when the manual cleansing is to be implemented, the ink-droplet ejection area 36 is located at the cleansing position C so as not to be opposed to the ejection surfaces 2*a* of the recording heads 2. This facilitates the manual cleansing and prevents the user from inadvertently contacting the recording heads 2, especially their ejection surfaces 2*a*, during the manual cleansing. Since the feeder belt 34 is made to travel so as to locate the ink-droplet ejection area 36 at the cleansing position C only when the manual cleansing is to be implemented, it is prevented that the feeder belt 34 travels uselessly or to no purpose, thereby saving the power.

Since the cleansing position C is defined within the range where the outer circumferential surface of the feeder belt 34 faces upward, the ink-droplet ejection area 36 as located at the cleansing position C is easily seeable or viewable. Since the cleansing position C is on the first belt roller 32, a portion of the feeder belt 34 corresponding to the ink-droplet ejection area 36 is supported by the first belt roller 32 from the lower side, when located at the cleansing position C. In the manual cleansing of the ink-droplet ejection area 36, this enables the user to apply a pressing force against the portion of the feeder belt 34 corresponding to the ink-droplet ejection area 36, thereby enhancing the efficiency of the manual cleansing. Since the cleansing position C has a definite range including at least a part of the range where the portion of the outer circumferential surface of the feeder belt 34 corresponding to, and being on the opposite side of, the contact portion of the inner circumferential surface of the feeder belt 34 where the inner circumferential surface is in contact with the first belt roller 32 is located, the portion of the feeder belt 34 corresponding to the ink-droplet ejection area 36 is supported by the first belt roller 32 when located at the cleansing position C. In the manual cleansing of the ink-droplet ejection area 36, this enables the user to apply a pressing force against the portion of the feeder belt 34 corresponding to the ink-droplet ejection area 36, thereby enhancing the efficiency of the manual cleansing.

The feeder belt 34 is made to travel to locate the ink-droplet ejection area 36 at the cleansing position C just after the cover 82 is opened. Thus, the feeder belt 34 is made to travel only immediately before the user implements the manual cleansing, contributing to power saving. Further, the user can quickly initiate the manual cleansing after opening the cover 82.

When the user opens the cover 82 for other purposes than the manual cleansing, the ink-droplet ejection area 36 is located within the range where the outer circumferential surface of the feeder belt 34 faces downward in order that the ink-droplet ejection area 36 is not seen by the user. Hence, it is prevented that the user seeing the ink-droplet ejection area 36 erroneously takes the ink-droplet ejection area 36 for an abnormality occurring on the feeder belt 34.

In addition, when the user sees the inside of the housing 8 along the axial direction of the first and second belt rollers 32, 31 from the outside of the housing 8 through the maintenance opening 81, the cleansing position C is seen on the right side of the recording heads 2. Hence, when the user implements the manual cleansing with his/her right hand, it is prevented that the right hand of the user contacts the recording heads 2, particularly the ejection surfaces 2*a* thereof.

Since the plate 25 indicates the cleansing position C, the user can see or check at the time of the manual cleansing that the ink-droplet ejection area 36 is accurately or properly located at the cleansing position C.

Since the ink-droplet ejection area 36 is white in color, it is possible to accurately and precisely read the printed test pattern by the image sensor 21.

When the cleansing determining portion 75 determines that the manual cleansing is necessary, the message or information prompting the user to implement the manual cleansing is presented on the touch panel 9. Hence, the user can implement the manual cleansing at an appropriate timing.

Since the cleansing position C is located outside the suction feeding range, it is inhibited that a pressing force is applied to the platen 37 from the upper side of the ink-droplet ejection area 36 during the manual cleansing.

Modification of the Embodiment

Figure 8:
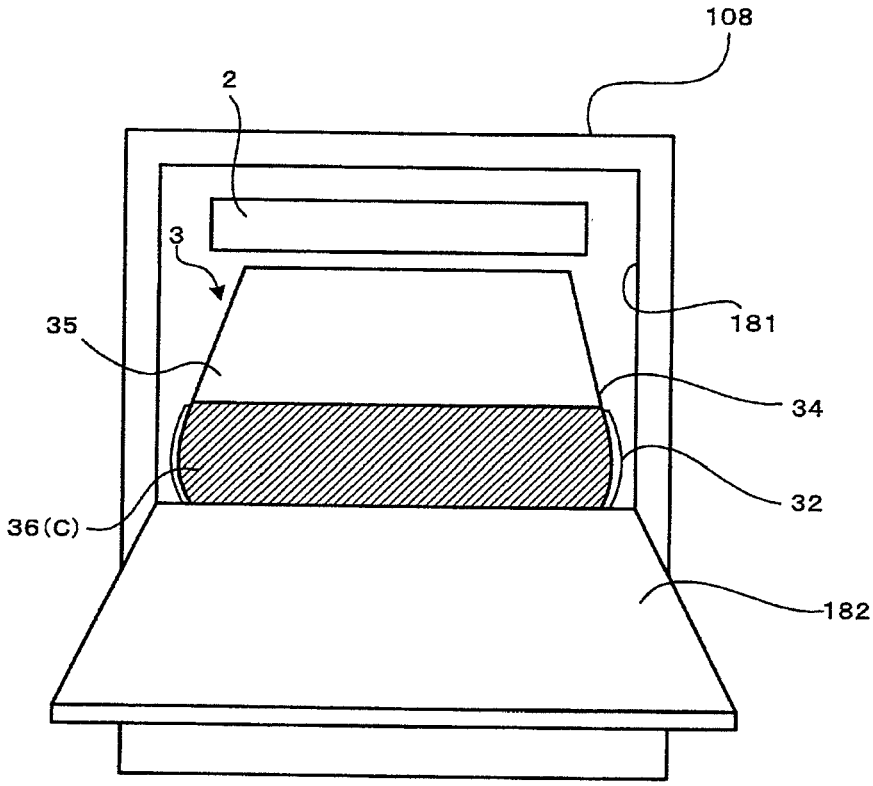
FIG. 8 is a rear view of an inkjet printer according to one modification of the embodiment.

There will be described one modification of the embodiment, referring to FIG. 8. In the modification, a housing 108 is employed in place of the housing 8. The housing 108 has a maintenance opening 181 formed at a rear side thereof, i.e., the right side as seen in FIG. 1. The feeding mechanism 3 is seeable from the outside of the housing 108 through the maintenance opening 181, in a direction parallel to the sheet feed direction at a portion of the sheet feed path opposed to the recording heads 2. When the inside of the housing 108 is thus seen, the cleansing position C is disposed between the maintenance opening 181 and the recording heads 2. The housing 108 further has a cover 182 openable and closable and covering the maintenance opening 181 when closed, and the cover opening sensor 12 (shown in FIG. 4) for detecting the state of the cover 182, that is, whether the cover 182 is open or closed. FIG. 8 shows a state where the feeding mechanism 3 is swung or turned about the shaft or axis of the second belt roller 31 to move the first belt roller 32 downward.

According to the modification, at the time of the manual cleansing the ink-droplet ejection area 36 is disposed on the near side of the recording heads 2 as seen from to the user. This further facilitates the manual cleansing and further reliably prevents the user from inadvertently contacting the recording heads 2, particularly the ejection surfaces 2*a* thereof.

Although there have been described one embodiment of the invention and one modification thereof, it is to be understood that the invention is not limited to the details thereof, but may be otherwise embodied with various other modifications and improvements that may occur to those skilled in the art, without departing from the scope and spirit of the invention defined in the appended claims.

For instance, in the embodiment described above, the cleansing position C is located on the first belt roller 32. However, the cleansing position may be disposed at other places as long as when located at the places the ink-droplet ejection area 36 is not opposed to the ejection surfaces 2*a* of the recording heads 2. For instance, the cleansing position may be located on the second belt roller 31, or alternatively within the range where the outer circumferential surface of the feeder belt 34 faces downward. When the cleansing position is located at such places, it is preferable that a maintenance opening is formed for allowing the manual cleansing of the ink-droplet ejection area 36 as located at the cleansing position.

In the embodiment, the cleansing determining portion 75 makes the image sensor 21 read the ink-droplet ejection area 36 to obtain the degree at which the inks are adhering to the ink-droplet ejection area 36, and determines whether the manual cleansing is necessary on the basis of the result of the reading. That is, the obtained degree at which the inks are adhering to the ink-droplet ejection area 36 is compared with a threshold, and when the degree is higher than the threshold, the cleansing determining portion 75 determines that the manual cleansing is necessary. However, the determination made by the cleansing determining portion 75 of whether the manual cleansing is necessary may be based on other conditions such as the number of times the test pattern has been printed on the ink-droplet ejection area 36, or the total operating time of the inkjet printer 1. That is, the property compared with a threshold in determining whether the manual cleansing is necessary may not be limited to the degree at which the inks are adhering to the ink-droplet ejection area 36.

In the embodiment, a message or information prompting the user to implement the manual cleansing is presented on the touch panel 9. However, the information that the manual cleansing is necessary may be transmitted to an upper level computer connected with the inkjet printer 1, or alternatively, such information may be stored as status information to be referenced, in an internal memory of the inkjet printer 1.

In the embodiment, the cleansing trigger is detected when the cleansing determining portion 75 determines that the manual cleansing is necessary and the user opens the cover 82. That is, the user's opening the cover 82 serves as a trigger for initiating the manual cleansing, i.e., the cleansing trigger. However, the embodiment may be modified such that whether the cleansing determining portion 75 determines that the manual cleansing is necessary or not, the cleansing trigger is detected every time the user opens the cover 82. Alternatively, the embodiment may be modified such that when the user inputs through the touch panel 9 an instruction to implement the manual cleansing, the cleansing trigger is detected. Further, the embodiment may be modified such that in addition to an opening-and-closing mechanism for opening and closing the cover 82, the cover 82 has a lock mechanism for inhibiting an operation of the opening-and-closing mechanism. That is, in this modification, the opening-and-closing mechanism is switchable between a locked state and a released state, and when an instruction to implement the manual cleansing is inputted through the touch panel 9 while the opening-and-closing mechanism is in the locked state, the lock mechanism operates to release the opening-and-closing mechanism from the locked state to allow the opening-and-closing mechanism to open and close the cover 82. In this modification, it may be arranged such that the cleansing trigger is detected by the trigger detecting portion 76 (i) when the cover 82 is opened, as in the above-described embodiment, (ii) when the instruction to implement the manual cleansing is inputted through the touch panel 9, or (iii) when the opening-and-closing mechanism is released from the locked state after the input of the instruction.

Although in the embodiment the ink-droplet ejection area 36 is white in color, the color of the ink-droplet ejection area 36 may be other than white.

In the embodiment, a recording sheet P is held within the sheet holding area 35 on the feeder belt 34 by the weak adhesion of the sheet holding area 35, and by air suction at the range where the recording sheet P is opposed to the ejection surfaces 2*a* of the recording heads 2. However, the recording sheet P may be otherwise held on the feeder belt 34. For instance, at the range corresponding to the suction feeding range where the recording sheet P is opposed to the ejection surfaces 2*a*, the recording sheet P may be held on the feeder belt 34 by electrostatic attraction, or alternatively by the weak adhesion only without the suction applied. Where such arrangements are employed, the suction holes 35*a* are not formed in the sheet holding area 35 and thus a recording sheet P can be more reliably held on the feeder belt 34 by adhesion, as compared to the case where the suction is applied. The inkjet printer 1 of the embodiment includes a mechanism for cleansing the ink-droplet ejection area 36 inside the housing 8, i.e., the belt cleaning mechanism. However, an inkjet printer not including the belt cleaning mechanism can employ the cleansing mechanism according to the embodiment of the invention. Where the inkjet printer 1 includes a mechanism for cleaning the inks adhering to the feeder belt 34 after a recording operation in which an image is recorded over an entire surface of a recording sheet is performed, that is, after borderless recording is performed, this mechanism (hereinafter referred to as "the borderless-recording cleansing mechanism") may also function as the belt cleaning mechanism. In the case where the borderless-recording cleansing mechanism also functions as the belt cleaning mechanism, the manual cleansing may be implemented for instance such that when it becomes difficult for the borderless-recording cleansing mechanism to decrease the degree at which the inks are adhering to the ink-droplet ejection area 36.

In the embodiment, the invention is applied to an inkjet printer where a recording sheet is fed by an endless feeder belt. However, the invention is applicable to an inkjet printer where a recording sheet is fed by being placed on an outer circumferential surface of a cylindrical drum.

What is claimed is:

1. A recording apparatus comprising:

a recording head having an ejection surface from which a droplet of a liquid is ejected;

a feeding mechanism which includes a plurality of rollers and an endless feeder belt wound around the rollers and having a feeding surface opposed to the ejection surface, the feeding mechanism feeding a recording medium placed on the feeding surface a part of which serves as a liquid-droplet ejection area onto which a droplet of the liquid is ejected;

a detector which detects a trigger for initiating a manual cleansing of the liquid-droplet ejection area; and a controller which controls the feeding mechanism such that when the detector detects the trigger, the liquid-droplet ejection area is located at a cleansing position where the liquid-droplet ejection area is not opposed to the ejection surface of the recording head, wherein the plurality of rollers comprises at least an upstream-side roller positioned on an upstream side of the recording head in a feeding direction and a downstream-side roller positioned on a downstream side of the recording head in the feeding direction, and the recording medium is supplied to the upstream-side roller form a supply cassette disposed under the feeder belt through guide members, wherein the downstream-side roller is configured to discharge the recording medium to an outside tray, and wherein the cleansing position is on the upstream-side roller, and is disposed within a range of the feeding surface that faces upward.

2. The recording apparatus according to claim 1, wherein the controller controls the feeding mechanism such that the feeder belt is made to travel by operating at least one of the rollers, so as to locate the liquid-droplet ejection area at the cleansing position.

3. The recording apparatus according to claim 1, wherein the cleansing position has a definite range including at least a part of a range where a portion of an outer circumferential surface of the feeder belt is located, the portion of the outer circumferential surface corresponding to, and being on the opposite side of, a contact portion of an inner circumferential surface of the feeder belt where the inner circumferential surface is in contact with one of the rollers.

4. The recording apparatus according to claim 1, further comprising a housing which accommodates the feeding mechanism and the recording head, and has an opening and a cover which is openable and closable and covers the opening when closed, wherein the detector detects as the trigger the cover being opened.

5. The recording apparatus according to claim 1, further comprising: a housing which accommodates the feeding mechanism and the recording head, and has an opening and a cover which is openable and closable and covers the opening when closed; and a cleansing determining portion which determines whether the manual cleansing is necessary, wherein the detector detects as the trigger that the cover is opened where the cleansing determining portion determines that the manual cleansing is necessary.

6. The recording apparatus according to claim 5, wherein the cleansing determining portion makes the determination of whether the manual cleansing is necessary on the basis of a degree at which the liquid is adhering to the liquid-droplet ejection area.

7. The recording apparatus according to claim 5, wherein the feeding mechanism is seeable from an outside of the housing through the opening, and the cleansing position is located on the right side of the recording head where an inside of the housing is seen from the outside of the housing along an axial direction of the rollers.

8. The recording apparatus according to claim 5, wherein the feeding mechanism is seeable from an outside of the housing through the opening, and the cleansing position is located between the opening and the recording head.

9. The recording apparatus according to claim 7, wherein the feeding mechanism has a mark indicating the cleansing position.

10. The recording apparatus according to claim 9, wherein the mark is oriented to be seen from the outside of the housing along the axial direction of the rollers.

11. The recording apparatus according to claim 1, further comprising a housing which accommodates the feeding mechanism and the recording head, and has an opening and a cover which is openable and closable and covers the opening when closed, wherein the controller controls the feeding mechanism such that when the cover is opened where the detector does not detect the trigger, the liquid-droplet ejection area is located within a range where the feeding surface faces downward.

12. The recording apparatus according to claim 1, wherein the liquid-droplet ejection area is white in color.

13. The recording apparatus according to claim 1, wherein the rollers include a first roller and a second roller disposed on a side of the recording head opposite to the first roller in a direction in which the recording medium is fed, and the feeding mechanism is turnable about an axis of the second roller in a direction to move the first roller downward.

14. The recording apparatus according to claim 13, wherein the cleansing position is on the first roller.

15. The recording apparatus according to claim 13, wherein the cleansing position has a definite range including at least a part of a range where a portion of the outer circumferential surface of the feeder belt is located, the portion corresponding to, and being on the opposite side of, a contact portion of the inner circumferential surface of the feeder belt where the inner circumferential surface is in contact with the first roller.

16. The recording apparatus according to claim 1, further comprising:

a sensor which reads the liquid-droplet ejection area;

a judging portion which determines on the basis of a result of the detection by the sensor whether a degree at which the liquid is adhering to the liquid-droplet ejection area is higher than a threshold; and a display portion which presents thereon information prompting a user to implement the manual cleansing when the judging portion determines that the degree at which the liquid is adhering to the liquid-droplet ejection area is higher than the threshold.

17. The recording apparatus according to claim 1, wherein the feeding mechanism has a suction feeding range at which the recording medium is fed while being held on the feeding surface by suction, and the cleansing position is outside the suction feeding range.

18. The recording apparatus according to claim 1, wherein a plurality of nozzles are formed in the ejection surface of the recording head, and the liquid-droplet ejection area is an area onto which droplets of the liquid are ejected to form a test pattern when ejection performance of the nozzles is checked.

19. The recording apparatus according to claim 1, further comprising:

a housing configured to accommodate the feeding mechanism and the recording head and have an opening and a cover which selectively opens and closes, wherein the liquid-droplet ejection area positioned at the cleansing position is exposed to an exterior of the housing through the opening in a direction parallel to the feeding direction when the cover is opened, wherein the upstream-side roller is positioned nearer to the cover than the downstream-side roller is positioned to the cover in the direction parallel to the feeding direction.

20. The recording apparatus according to claim 1, wherein the controller controls the feeder belt to move the liquid-droplet ejection area to the cleansing position when the detector detects the trigger, and stops the feeder belt from moving until a completion of the manual cleansing of the liquid-droplet ejection area.

* * * * *